US007975625B2

(12) United States Patent
Topham et al.

(10) Patent No.: US 7,975,625 B2
(45) Date of Patent: Jul. 12, 2011

(54) FOLDING TABLE

(75) Inventors: Katie Staples Topham, Salt Lake City, UT (US); Jay Calkin, Ogden, UT (US); Larry Larcom, Roy, UT (US); Paul Branch, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 127 days.

(21) Appl. No.: 12/237,111

(22) Filed: Sep. 24, 2008

(65) Prior Publication Data

US 2009/0078173 A1 Mar. 26, 2009

Related U.S. Application Data

(60) Provisional application No. 60/974,732, filed on Sep. 24, 2007.

(51) Int. Cl.
*A47B 3/00* (2006.01)

(52) U.S. Cl. ..... 108/115; 108/79; 108/132

(58) Field of Classification Search ..... 108/131, 108/132, 129, 115, 79, 78, 77; 248/188.6
See application file for complete search history.

(56) References Cited

U.S. PATENT DOCUMENTS

| | | | | |
|---|---|---|---|---|
| 318,298 | A | 5/1885 | Roberts | |
| 643,511 | A | 2/1900 | Lloyd | |
| 1,614,187 | A | 1/1927 | Coggins | |
| D80,586 | S * | 2/1930 | Thomas | D6/429 |
| 1,765,766 | A | 6/1930 | Lyon | |
| 1,976,140 | A | 10/1934 | Paul | |
| 2,055,007 | A * | 9/1936 | Erpelding | 108/124 |
| 2,542,394 | A | 2/1951 | Cohen et al. | |
| 2,563,891 | A * | 8/1951 | Wallance | 108/79 |
| 2,619,394 | A | 11/1952 | Mahr | |
| 2,639,761 | A | 5/1953 | Schenzinger et al. | |
| 2,696,416 | A | 12/1954 | Stedman | |
| 2,729,526 | A * | 1/1956 | Humphrey | 108/79 |
| 2,730,418 | A | 1/1956 | Blink | |
| 2,747,957 | A | 5/1956 | Lencioni | |
| 2,871,076 | A | 1/1959 | Mell | |
| 2,872,259 | A | 2/1959 | Thorpe | |
| 3,143,982 | A | 8/1964 | Blink et al. | |

(Continued)

FOREIGN PATENT DOCUMENTS

GB 2059255 4/1981

(Continued)

*Primary Examiner* — José V Chen
(74) *Attorney, Agent, or Firm* — Maschoff Gilmore & Israelsen, PLLC

(57) ABSTRACT

A table may include a table top and at least one leg assembly. The table top may include a first table top section and a second table top section. The table top sections may be movable between a first position in which the table top sections are generally aligned and a second position in which the table top sections are at an angle. The leg assembly may be movable between an extended position and a collapsed position relative to the table top. The leg assembly may include a first support structure and a second support structure. The support structures may be movable between a generally aligned position and an angled position when the leg assembly is in the extended position. Moving the support structures to the angled position may help retain the leg assembly in the extended position. Moving the table top sections to the second position may help retain the support structures in the angled position and thus further help retain the leg assembly in the extended position.

20 Claims, 11 Drawing Sheets

U.S. PATENT DOCUMENTS

| | | | | |
|---|---|---|---|---|
| 3,246,614 | A | 4/1966 | Loesch | |
| 3,368,504 | A | 2/1968 | Cohen | |
| 3,379,145 | A | 4/1968 | Lieberman | |
| 3,606,845 | A * | 9/1971 | Hickman | 108/79 |
| 3,656,439 | A | 4/1972 | Domin | |
| D225,501 | S | 12/1972 | Apple, Jr. | |
| 3,866,913 | A | 2/1975 | Zimmers et al. | |
| D241,672 | S | 9/1976 | Rica | |
| 4,005,898 | A | 2/1977 | Way | |
| D247,080 | S | 1/1978 | Robinson | |
| D247,401 | S | 3/1978 | Cohen | |
| 4,089,522 | A | 5/1978 | Rock | |
| D248,703 | S | 8/1978 | Morgan, Jr. | |
| 4,133,271 | A | 1/1979 | Carlson | |
| D252,965 | S | 9/1979 | Petersen | |
| 4,489,661 | A | 12/1984 | Fitzgerald | |
| 4,653,804 | A | 3/1987 | Yoo et al. | |
| 4,841,877 | A | 6/1989 | Virtue | |
| 4,883,314 | A | 11/1989 | Sakong | |
| 4,911,085 | A | 3/1990 | Pencoske | |
| 5,009,170 | A | 4/1991 | Spehar | |
| 5,154,441 | A | 10/1992 | White et al. | |
| 5,357,872 | A | 10/1994 | Wilmore | |
| 5,377,601 | A | 1/1995 | Cashen | |
| 5,381,740 | A | 1/1995 | Johnston | |
| D355,318 | S | 2/1995 | Gutgsell | |
| 5,421,272 | A | 6/1995 | Wilmore | |
| 5,501,157 | A | 3/1996 | Westerburgen | |
| 5,730,066 | A | 3/1998 | Auten et al. | |
| D408,177 | S | 4/1999 | Stout | |
| D414,626 | S | 10/1999 | Collins et al. | |
| 5,983,807 | A | 11/1999 | Tarnay et al. | |
| 6,000,345 | A | 12/1999 | Gillotti | |
| D420,527 | S | 2/2000 | Pinch | |
| 6,032,585 | A | 3/2000 | Pinch | |
| 6,058,853 | A | 5/2000 | Pinch | |
| 6,112,674 | A | 9/2000 | Stanford | |
| 6,164,217 | A * | 12/2000 | Prendergast | 108/115 |
| 6,314,892 | B1 * | 11/2001 | Favini | 108/115 |
| 6,334,400 | B1 | 1/2002 | Nien | |
| 6,454,357 | B1 | 9/2002 | Foulger | |
| 6,494,147 | B1 | 12/2002 | Schulte et al. | |
| D468,135 | S | 1/2003 | Ashby et al. | |
| D479,778 | S | 9/2003 | Haney et al. | |
| 6,629,504 | B2 | 10/2003 | Stern | |
| 6,637,352 | B1 * | 10/2003 | Thode et al. | 108/132 |
| 6,684,426 | B1 | 2/2004 | Lin et al. | |
| 6,752,091 | B2 | 6/2004 | Glover et al. | |
| 6,763,769 | B2 | 7/2004 | Ballendat | |
| 6,845,723 | B2 * | 1/2005 | Kottman et al. | 108/132 |
| 6,905,166 | B2 | 6/2005 | Zhurong et al. | |
| 6,997,115 | B2 * | 2/2006 | Lockwood et al. | 108/115 |
| 7,066,098 | B2 * | 6/2006 | Blasen et al. | 108/115 |
| 7,096,799 | B2 | 8/2006 | Strong et al. | |
| 7,299,753 | B2 | 11/2007 | Strong | |
| 2002/0092445 | A1 | 7/2002 | Glover et al. | |
| 2005/0274304 | A1 | 12/2005 | Strong | |
| 2006/0005748 | A1 | 1/2006 | Christians | |
| 2006/0021550 | A1 | 2/2006 | Sagol | |
| 2006/0236902 | A1 * | 10/2006 | Haney et al. | 108/115 |
| 2008/0017083 | A1 | 1/2008 | VanNimwegen et al. | |
| 2008/0245278 | A1 * | 10/2008 | Larcom et al. | 108/131 |

FOREIGN PATENT DOCUMENTS

| | | |
|---|---|---|
| GB | 2223401 | 4/1990 |

* cited by examiner

FOLDING TABLE

CROSS-REFERENCE TO RELATED APPLICATIONS

This application claims priority to and the benefit of U.S. provisional patent application Ser. No. 60/974,732, filed on Sep. 24, 2007, which is incorporated by reference in its entirety.

BACKGROUND OF THE INVENTION

1. Field of the Invention

The present invention is generally directed towards furniture and, in particular, towards tables.

2. Description of Related Art

Conventional tables are used for a variety of purposes and come in a wide array of designs. In some situations, it is desirable to have a table that is adjustable. For example, it may be desirable to have a table that is adjustable in height. It may also be desirable to have a table that can be folded into a more compact configuration for storage or transport. Disadvantageously, many conventional tables are difficult to adjust the height or require complex mechanisms allow the tables to fold into a more compact configuration.

Conventional tables often include table tops constructed from wood, particle board or metal. Table tops constructed from wood, particle board or metal, however, are often relatively heavy and this may make the table awkward or difficult to move. Conventional table tops constructed from wood or metal are also relatively expensive and the table tops must generally be treated or finished before use. For example, table tops constructed from wood must generally be sanded and painted, and metal table tops must be formed into the desired shape and painted. In addition, these relatively heavy table tops increase the cost of transportation, shipping, and storage of the tables.

In order to decrease the weight of conventional tables, table tops can be constructed from relatively thin, light-weight materials. Disadvantageously, table tops constructed from light-weight materials may require reinforcing members, such as frames, railings, brackets and the like, to strengthen the table top. These reinforcing members may increase the strength of the table top, but these additional parts also increase the weight of the table. In addition, these additional parts increase manufacturing costs and require additional time to assemble the table. Furthermore, these additional parts may have sharp edges that can injure the user's legs, arms or other body parts.

BRIEF SUMMARY OF EMBODIMENTS OF THE INVENTION

A need therefore exists for a table that eliminates or diminishes the disadvantages and problems described above.

One aspect is a table that may include a table top with one or more sections. For example, the table top may include two sections and one or both of the sections may be movable. In particular, the table top may include first and second sections, and the second section may be movable relative to the first section. Desirably, the second section may be movable between a first position in which the first and second sections are generally aligned and a second position in which the second section is disposed at an angle relative to the first section. For instance, the second section may extend downwardly relative to the first section. Preferably, the second section extends downwardly and is disposed generally perpendicular or at about a 90 degree angle relative to the first section. This may allow the second panel to form a modesty or privacy panel, if desired.

Advantageously, the table may be used when the first and second table top sections are aligned and when the second section is disposed at an angle relative to the first section. For example, when the first and second table top sections are aligned, the table has a relatively large table top and it may be used by multiple people and/or used to support a number of objects. On the other hand, when the second section is disposed at an angle relative to the first section, then the table has a smaller table top and it may be used by fewer people and/or used to support fewer objects. This may allow the table to be used in larger and smaller areas, used for different purposes, and used in a wide variety of different environments and situations.

Another aspect is a table that may include a table top with sections that are pivotally connected. The pivotal connection may allow the table top sections to move between the first and second positions. The table top sections may be interconnected using hinges or other suitable connectors. If desired, the hinges may be used to limit and/or control the movement of the sections. For example, the hinges may limit the movement of the panels to about 90 degrees.

Yet another aspect is a table that may include a table top with one or more sections that have engaging, abutting and/or overlapping portions. For example, the table top sections may include engaging portions that are sized and configured to contact, abut, engage and/or overlap with an adjacent table top section. These engaging portions may extend outwardly or protrude from an edge of a table top section. The table top sections may also include receiving portions that are sized and configured to receive at least a portion of the engaging portions. Advantageously, the engaging and receiving portions may help maintain the upper surfaces of the table top sections in the desired locations. The engaging and receiving portions may also provide extra strength, stiffness and/or rigidity to the table top. In addition, the engaging and receiving portions may help form a decorative corner or edge of the table top. Further, the engaging and receiving portions may help hide at least a portion of a frame from view when the table is being used.

Still another aspect is a table that may include one or more table top sections and one or more leg assemblies. For example, the table top may include two table top sections that are movable between a first position in which the table top sections are generally aligned and a second position in which the table top sections are disposed at an angle. In particular, in the first position, the first and second table top sections may be generally aligned and disposed in a generally horizontal position, which may allow both sections of the table top to be used as a table. On the other hand, when the table top is in the second position, the first section may remain in the generally horizontal position and may still be used as a table while the second section may be positioned at an angle relative to the first section. In this position, the second section is preferably disposed at about a 90 degree angle relative to the first section and it may create a privacy or modesty panel. In addition, the table may include two leg assemblies and at least a portion of the leg assemblies may be movable relative to the table top. For instance, a portion of the leg assemblies may be moved between a first position and a second position. In the first position, the leg assemblies preferably support both the first and second sections of the table top in the generally planar, horizontal position. In the second position, the leg assemblies preferably allow the second section of the table top to be disposed in the second position.

A further aspect is a table that may include leg assemblies that are moveable between a first position, which may support the table top sections in the first position, and a second position, which may allow the table top sections to be disposed in the second position. For example, the leg assemblies may include one or more support structures and the support structures may be generally aligned when the leg assemblies are in the first position. When the leg assemblies are in the second position, the support structures may be disposed at an angle. In greater detail, when the support structures are generally aligned in the first position, the leg assemblies may support both the first and second sections of the table top in the use or first position. When the support structures are disposed at an angle in the second position, the support structures may allow the second section of the table top to be disposed in the second position. In greater detail, when the support structures are disposed in the second position, the support structures may be spaced apart from the second section of the table top, which may permit the second section of the table top to be moved between the first and second positions.

A still further aspect is a table that may include leg assemblies that are movable between a use or extended position and a collapsed or storage position. In the use or extended position, the leg assemblies preferably extend outwardly from the table top and are sized and configured to support the table top above a surface, such as the ground. In the collapsed or storage position, the leg assemblies are preferably disposed at least proximate a lower surface of the table top. In addition, when in the extended position, the leg assemblies may be movable between a first position in which the first and second sections of the table top may be supported in a use position and a second position in which the second section of the table top may be moved between the use position and a different position. For example, the leg assemblies may include first and second support structures and these support structures may be pivotally or otherwise connected to permit the second support structure to pivot or move relative to the first support structure. In particular, the first and second support structures may be moved between a generally aligned position and an angled position. If desired, this may allow the second support structure to swing like a gate between the generally aligned position and the angled position.

Another further aspect is a table that may include leg assemblies with first and second support structures. The support structures may include upper support members, lower support members, and one or more legs connecting the upper and lower support members. The upper support members may be pivotally connected to facilitate movement of the second support structure relative to the first support structure. In addition, the lower support members of the first and second support structures may be pivotally connected to facilitate movement of the second support structure relative to the first support structure. These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention generally relates to furniture and, in particular, to tables. The principles of the present invention, however, are not limited to tables. It will be understood that, in light of the present disclosure, the various features, aspects and designs disclosed herein can be successfully used in connection with other types of furniture and/or structures.

Additionally, to assist in the description of the table, words such as top, bottom, front, rear, right and left may be used to describe the accompanying figures, which may be but are not necessarily drawn to scale. It will be appreciated that while various features, aspects, shapes, sizes, configurations and arrangements of the table are described in detail below, the table can have other suitable features, aspects, shapes, sizes, configurations and arrangements. It will also be appreciated that the table may be disposed in a variety of desired locations, positions and/or orientations. A detailed description of the table now follows.

Figure 1:
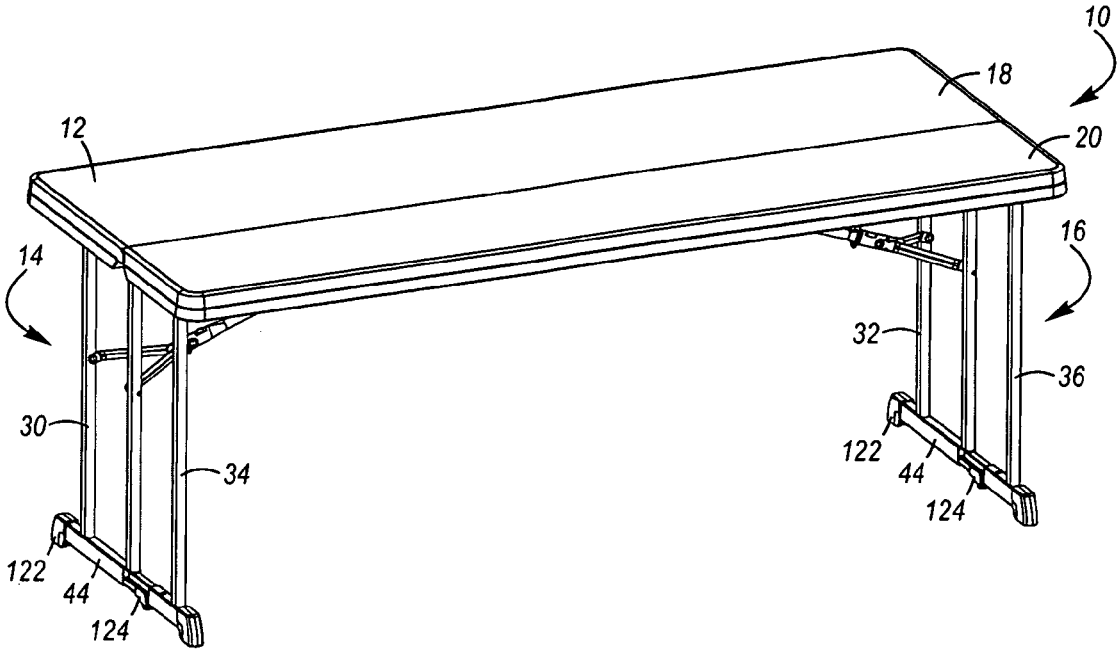
FIG. 1 is a perspective view of an exemplary table including a table top with a pair of table top sections and a pair of leg assemblies, illustrating the table top sections in a first, generally aligned position and the leg assemblies in a first, generally aligned position.
Figure 2:
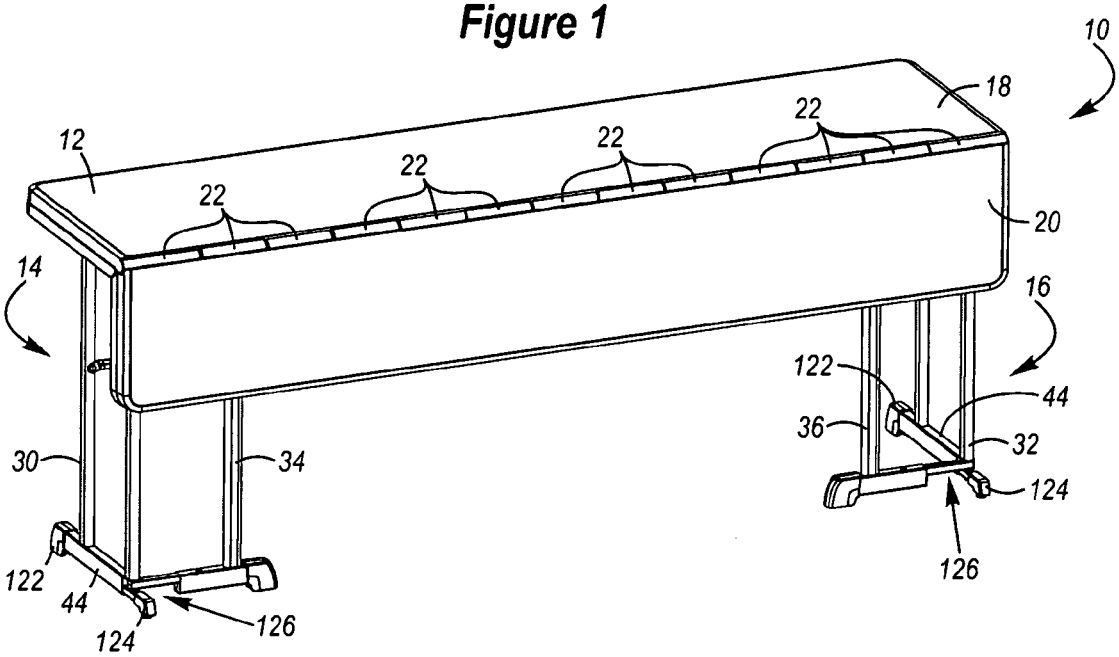
FIG. 2 is a perspective view of the table shown in FIG. 1, illustrating the table top sections in a second, angled position and the leg assemblies in a second, angled position.

As shown in FIG. 1, an exemplary table 10 may include a table top 12 and two leg assemblies 14, 16, which may be sized and configured to support the table top above a surface. The table top 12 may include first and second table top sections 18, 20, and one or both of the sections may be movable. For example, the second table top section 20 may be movable between a first position in which the first and second table top sections are generally aligned, such as shown in FIG. 1, and a second position in which the table top sections are disposed at an angle, such as shown in FIG. 2.

As shown in the accompanying figures, the table top 12 may have a generally rectangular shape and a seam may be disposed between the first and second table top sections 18, 20. The seam preferably extends along the length of the table top 12, but it may also extend along the width or other suitable portion of the table top. It will be appreciated that the table top 12 may have other suitable shapes, such as square, circular, oval and the like. It will also be appreciated that the table top 12 may have a variety of suitable sizes, such as a length of two, four, six, eight or ten feet, and a width of two, three or four feet. Of course, the table top 12 may be larger or smaller depending, for example, upon the intended use of the table 10.

In further detail, when the table top sections 18, 20 are in the first position, the upper surfaces of the table top section may be generally aligned and disposed in the same plane. Advantageously, this may allow the entire upper surface of the table top 12 to be used as a table. When the table top sections 18, 20 are in the second position, the first table top section may remain in a generally horizontal or level position, which may allow this section of the table top 12 to be used as a table, and the second table top section 20 may be disposed at an angle. Desirably, in the second position, the second section 20 extends downwardly relative to the first section 18. In particular, the second section 20 may be disposed perpendicular or at about a 90 degree angle relative to the table top section 18. In the second position, the second section 20 of the table top 12 may create a privacy or modesty panel.

Figure 4:
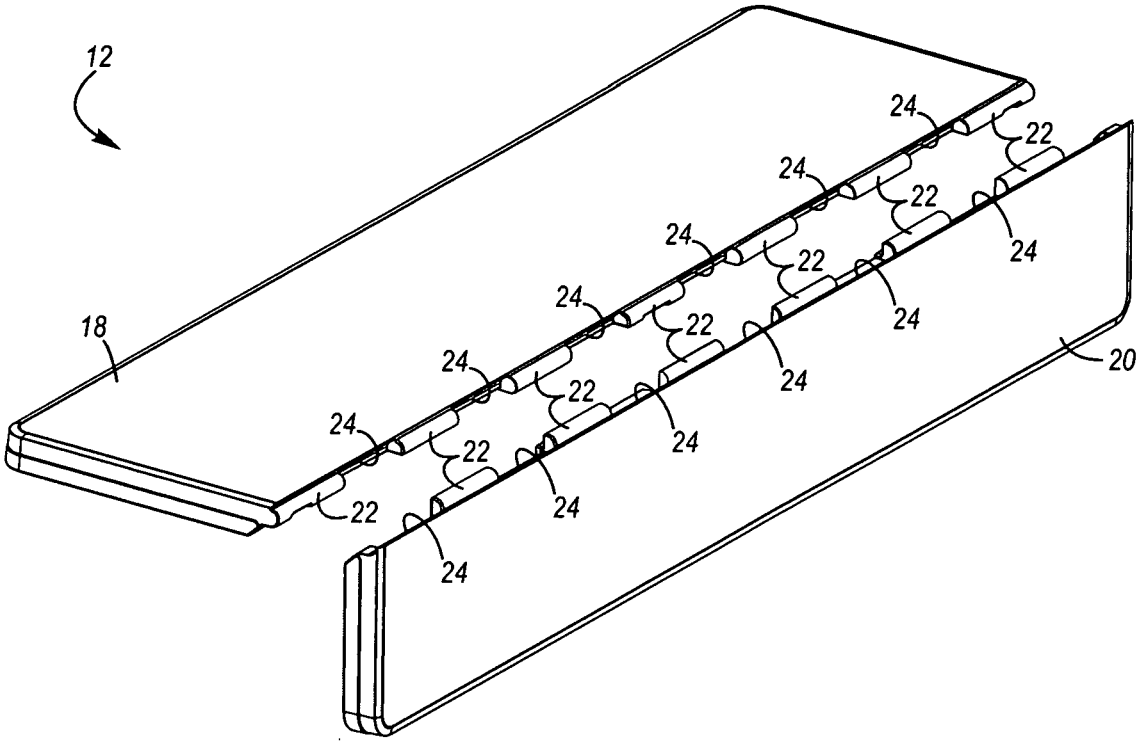
FIG. 4 is an exploded, upper perspective view of a portion of the table shown in FIG. 2.

As shown in FIG. 4, the table top sections 18, 20 may include one or more engaging and/or receiving portions. These engaging and/or receiving portions may extend outwardly from the table top section 18, 20, or may be formed in the table top sections. In addition, these engaging and/or receiving portions may contact, abut, engage, interlock and/or overlap. For example, the first table top section 18 may include one or more engaging and/or receiving portions and the second table top section 20 may include one or more engaging and/or receiving portions, and these engaging and/or receiving portions may contact, abut, engage, interlock and/or overlap. Advantageously, these engaging and/or receiving portions may help maintain the upper surfaces of the first and second table top sections 18, 20 aligned in generally the same plane when the table top sections are disposed in the first position. In addition, these engaging and/or receiving portions may help increase the strength, stiffness and/or rigidity of the edges of the table top sections 18, 20.

Figure 3:
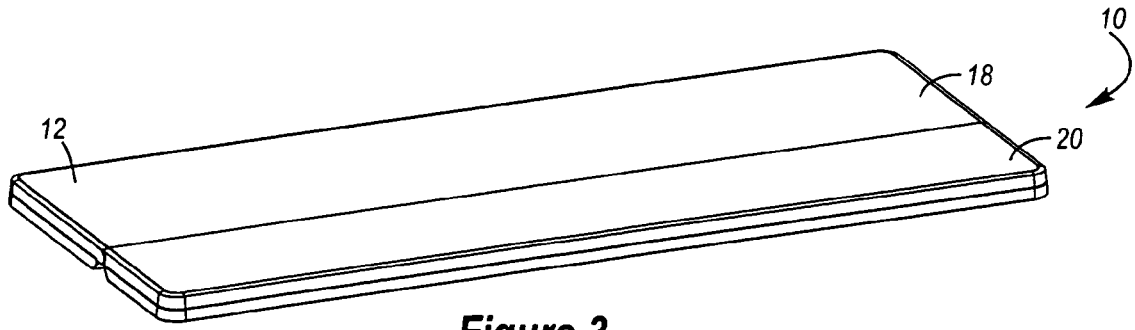
FIG. 3 is a perspective view of the table shown in FIG. 1, illustrating the leg assemblies in a collapsed position.

These engaging and/or receiving portions may include projections 22 and recesses 24. These projections 22 and recesses 24 may be sized and configured to interlock and/or overlap when the table top sections 18, 20 are generally aligned (such as shown in FIGS. 1 and 3) and/or when the table top sections are disposed at an angle (such as shown in FIG. 2).

The projections 22 and recesses 24 may also facilitate moving the first and second sections 18, 20 of the table top between the first and second positions. The projections 22 and recesses 24 may also contact, abut and/or engage each other, which may resist horizontal and/or vertical separation of table top sections 18, 20. In addition, the engaging and/or receiving portions may help provide a corner that may be free or at least substantially free from openings or gaps between the table top sections 18, 20, whether the table top sections are disposed in the first position or the second position. This may allow, for example, a frame or other support structures to be at least partially hidden from view when the table is being used.

In further detail, the first table top section 18 may include a plurality of recesses 24 that are sized and configured to receive and/or retain corresponding projections 22 from the second table top section 20. Similarly, the second table top section 20 may include a plurality of recesses 24 that are sized and configured to receive and/or retain corresponding projections 22 from the first table top section 18. Desirably, each projection 22 is disposed within a corresponding recess 24, but any suitable number of projections could be disposed in any suitable number of recesses. In addition, at least a portion of the projections 22 may be disposed in the corresponding recesses 24 when the table top sections 18, 20 are in the first, generally aligned position and in the second, angled position. The projections 22, however, do not have to be disposed in the recesses 24. For instance, when the table top sections 18, 20 are in the second position, the projections 22 may not be disposed in the recesses 24.

Desirably, at least a portion of the projections 22 and the recesses 24 contact, abut and/or engage each other, which may help maintain the first and second sections 18, of the table top 12 in the desired positions. In addition, the projections 22 and the recesses 24 may help resist horizontal and/or vertical separation of table top sections 18, 20, whether the table top sections are aligned in the first position or disposed at an angle in the second position.

Figure 5:
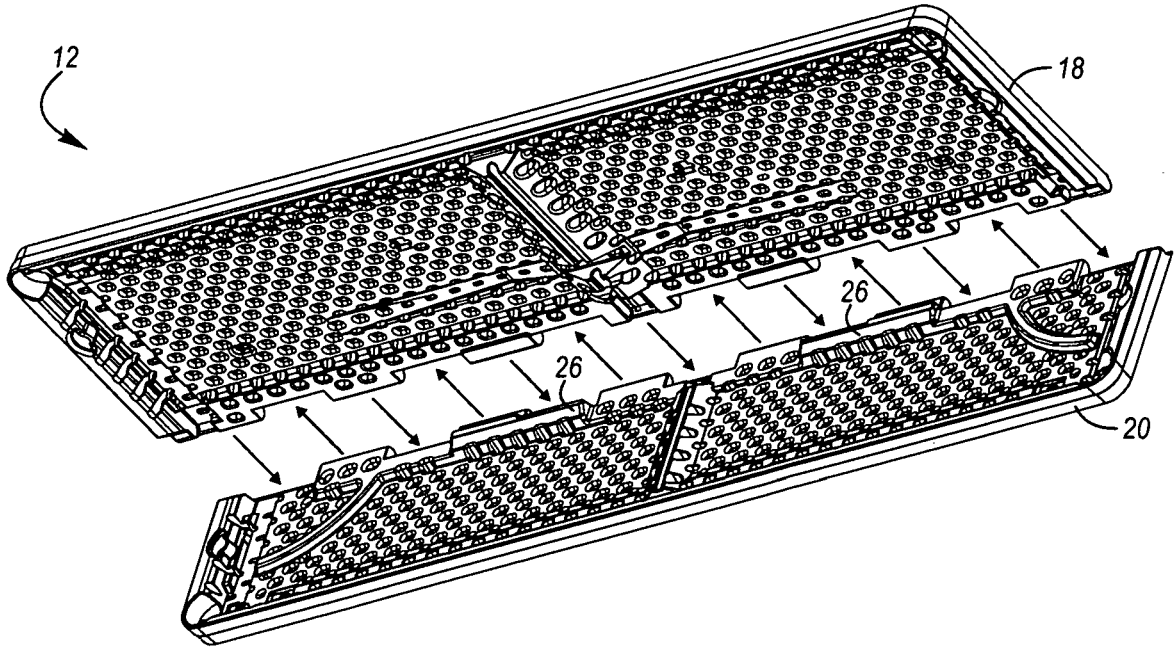
FIG. 5 is an exploded, lower perspective view of a portion of the table shown in FIG. 2.
Figure 6:
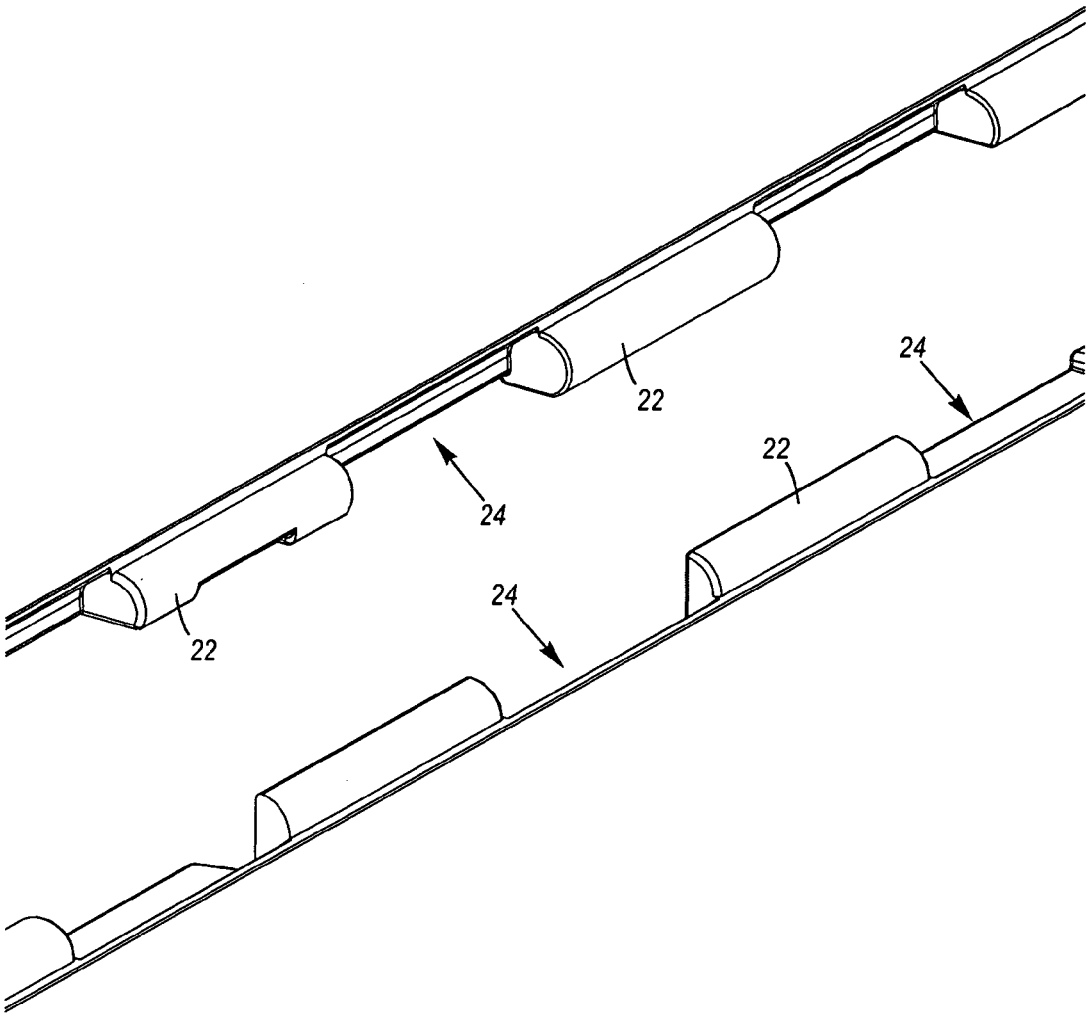
FIG. 6 is an enlarged view of a portion of the table top shown in FIG. 4.

As shown in FIGS. 4-6, the projections 22 and the recesses 24 may have rounded portions. For example, the projections 22 may have rounded, generally convex outer surfaces and the recesses 24 may have rounded, generally concave inner surfaces. The outer surfaces of the projections 22 and the inner surfaces of the recesses 24 are preferably complementary. In addition, the outer surfaces of the projections 22 and the inner surfaces of the recesses may be sized and configured to contact, abut and/or engage. In addition, the generally convex-shaped portions of the projections 22 may be generally aligned with each other when the table top sections 18, 20 are disposed at an angle, as shown in FIG. 2. This may allow the connection of the table top sections 18, 20 to be at least substantially free from any openings or gaps, whether the table top sections are aligned or disposed at an angle. Moreover, this may help provide a visually appealing and/or decorative edge of the table 10, if desired. It will be appreciated, however, that the projections 22 and the recesses 24 do not require rounded portions and may have other suitable shapes, sizes, configurations and arrangements. It will also be appreciated that the table top sections 18, 20 do not require the projections 22 or the recesses 24. It will further be appreciated that the table top sections 18, 20 do not require interlocking and/or overlapping portions.

Figure 7:
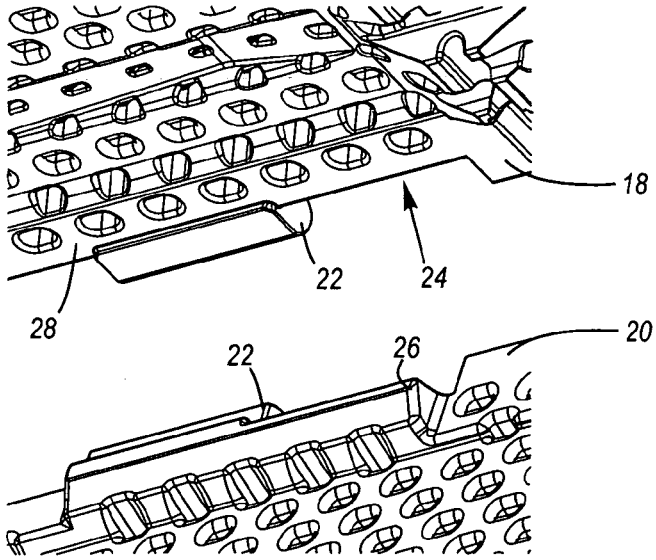
FIG. 7 is an enlarged view of a portion of the table top shown in FIG. 5.

As shown in FIGS. 5 and 7, the table top section 20 may include reinforcing members 26. For example, when the table top sections 18, 20 are disposed at an angle, the reinforcing member 26 may contact, abut and/or engage a portion of a lower surface 28 of the table top section 18. Advantageously, this may help strengthen and/or reinforce the edge of the table top section 18. In particular, when a load is applied to the top of the table top section 18, the reinforcing member 26 may contact, abut and/or engage a portion of the lower surface 28 to allow the reinforcing member 26 to bear at least a portion of the load. If desired, the reinforcing member 26 may be spaced apart from the portion of the lower surface 28 when the table top sections 18, 20 are generally aligned.

The projections 22, recesses 24 and reinforcing members 26 are preferably integrally formed with the first and second sections 18, 20 of the table top 12. For example, as discussed in greater detail below, the table top sections 18, 20 may be constructed from blow-molded plastic and the projections 22, recesses 24 and reinforcing members 26 may be integrally formed with the table top sections during the blow-molding process. In addition, the table top sections 18, 20 may include hollow interior portions that are formed during the blow-molding process and the projections 22, recesses 24 and reinforcing members 26 may also include hollow interior portions that are formed during the blow-molding process. Preferably, the hollow interior portions of the table top sections 18, 20 are in direct communication with the hollow interior portions of the projections 22, recesses 24 and reinforcing members 26. It will be appreciated that the table top 12 does not have to be constructed from blow-molded plastic and it could be made from other suitable materials and processes. It will also be appreciated that the table top sections 18, 20 and the projections 22, recesses 24 and reinforcing members 26 do not have to be integrally formed and each component may be individually formed using various appropriate materials and processes.

As shown in the accompanying figures, the table 10 may include first and second leg assemblies 14, 16. The leg assemblies 14, 16 are preferably sized and configured to support the first and second sections 18, 20 of the table top 12. In particular, the leg assemblies 14, 16 may support the first and section sections 18, 20 of the table top 12 when the first and second sections are in the generally aligned, first position shown in FIG. 1. The leg assemblies 14, 16 may also support first and second table top sections 18, 20 in the angled, second position shown in FIG. 2.

Figure 8:
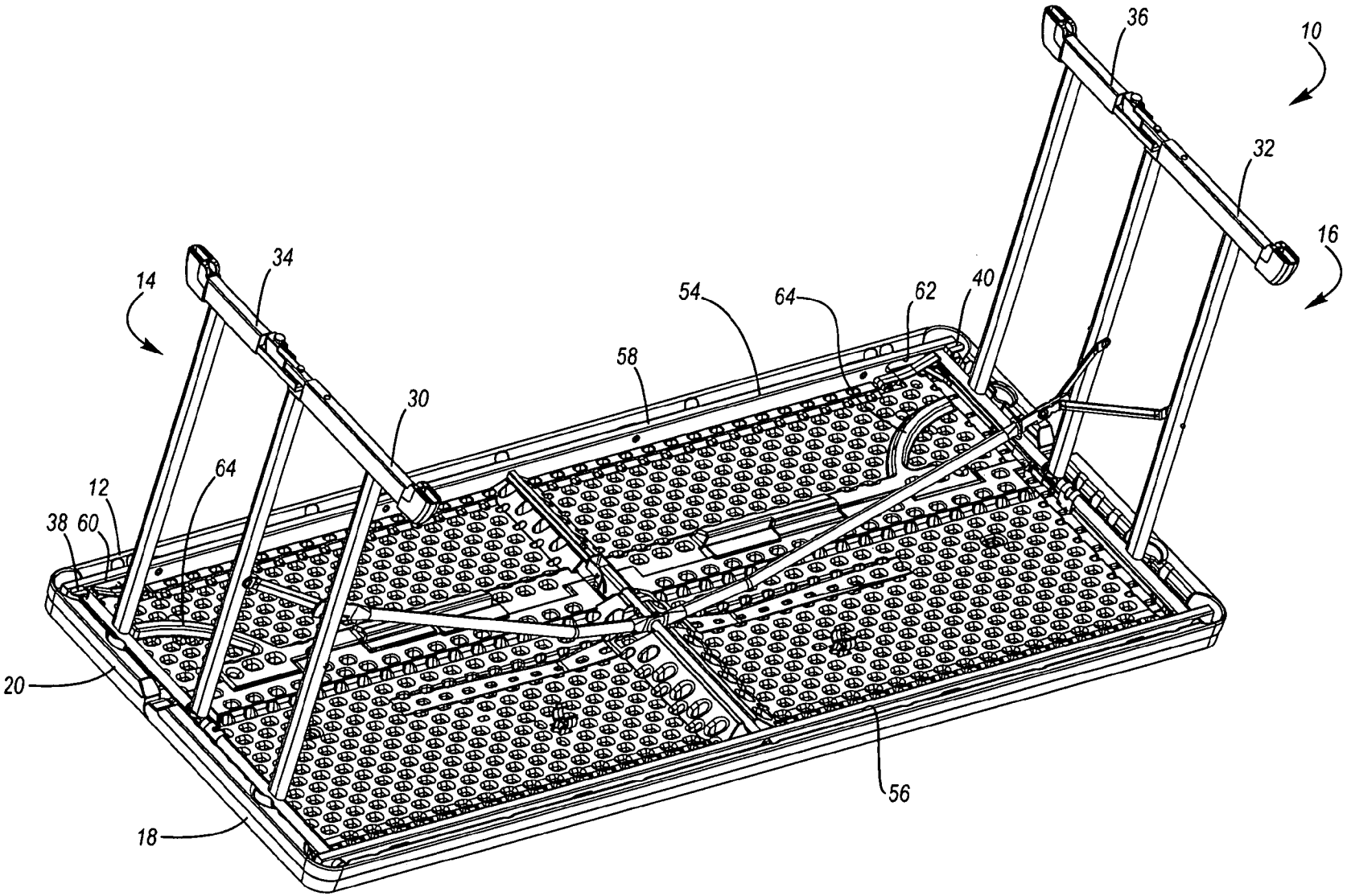
FIG. 8 is a lower perspective view of the table shown in FIG. 1.
Figure 9:
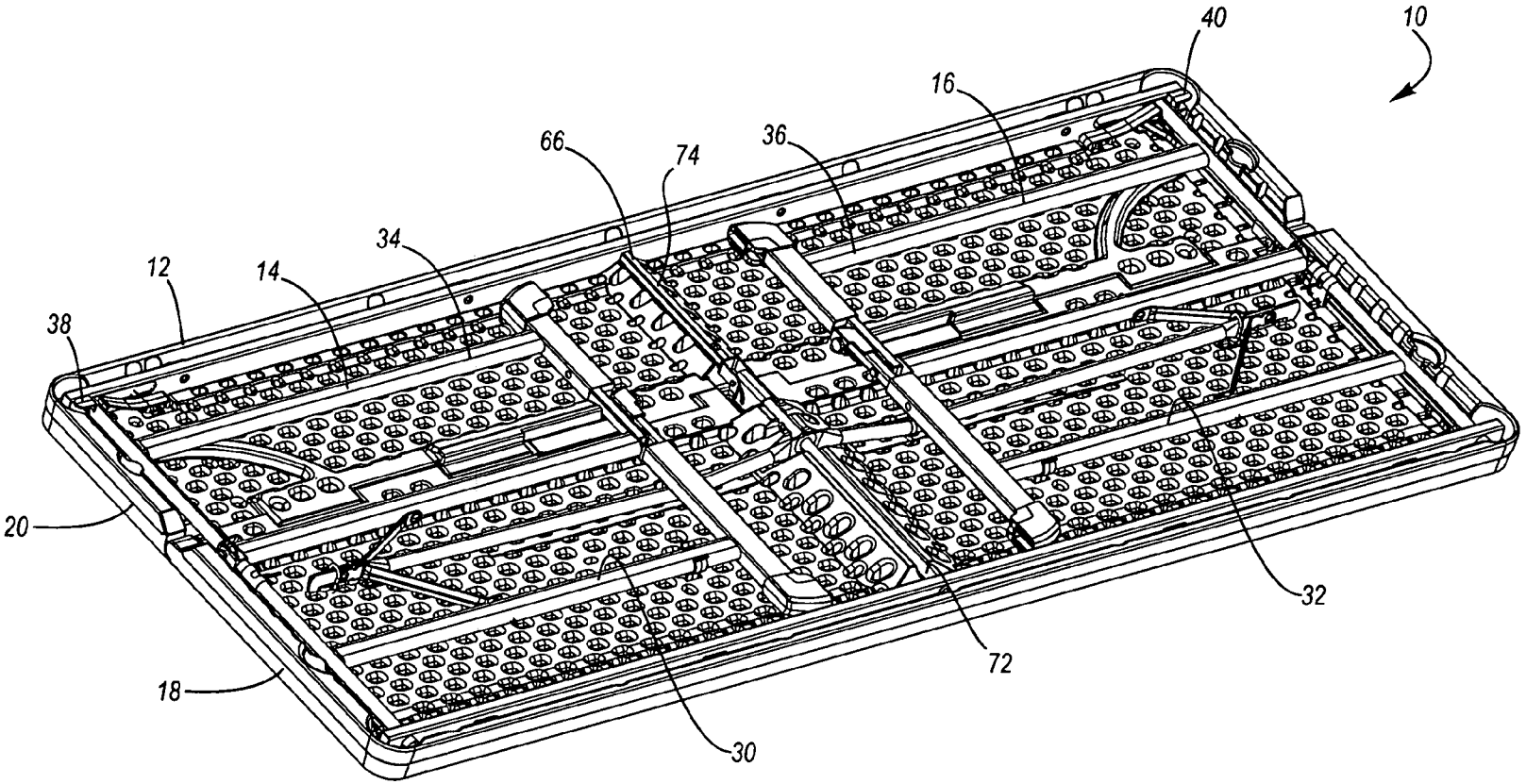
FIG. 9 is a lower perspective view of the table shown in FIG. 3.

In addition, the leg assemblies 14, 16 may be movable relative to the table top 12 between an extended or use position, as shown in FIG. 8, and a collapsed or storage position, as shown in FIG. 9. Advantageously, when the leg assemblies 14, 16 are in the extended or use position, the table 10 may be used. When the leg assemblies are in the collapsed or storage position, the table 10 may be more easily transported or stored. Preferably, the leg assemblies 14, 16 can be folded between the use and collapsed positions.

Figure 10:
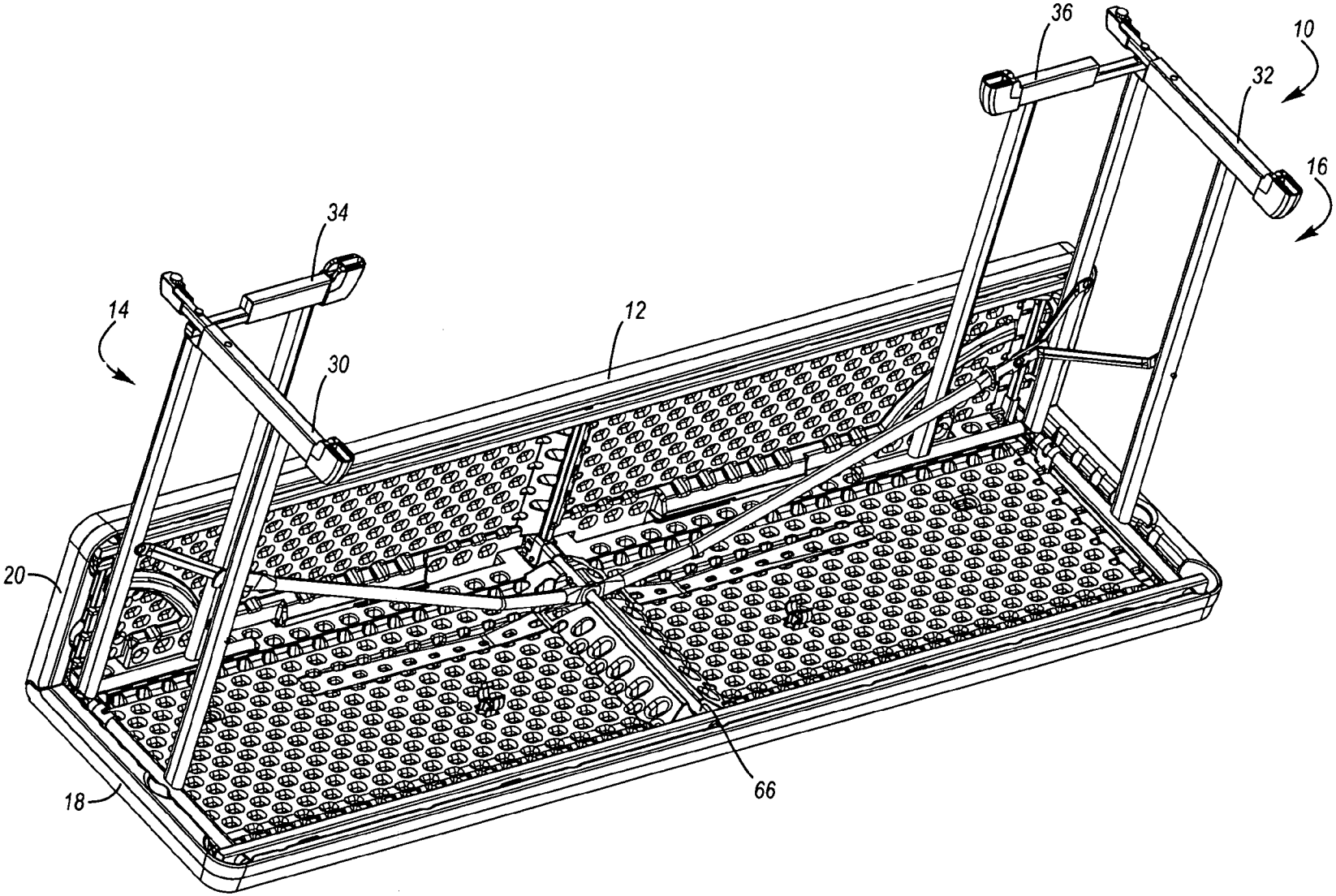
FIG. 10 is a lower perspective view of the table shown in FIG. 2.
Figure 12:
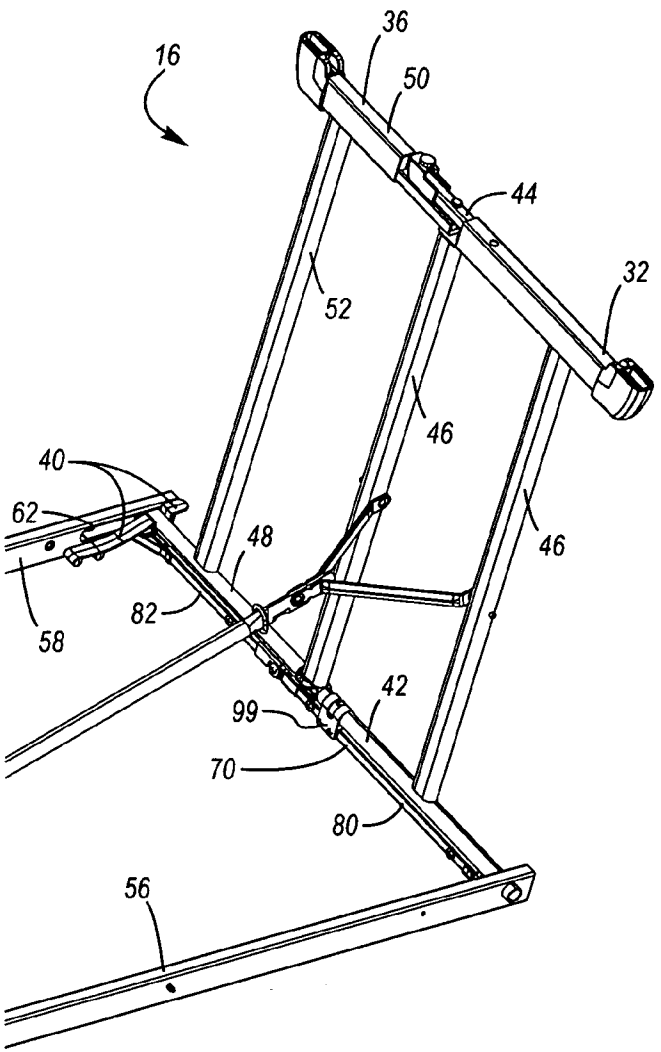
FIG. 12 is a lower perspective view of another portion of the table shown in FIG. 8.
Figure 11:
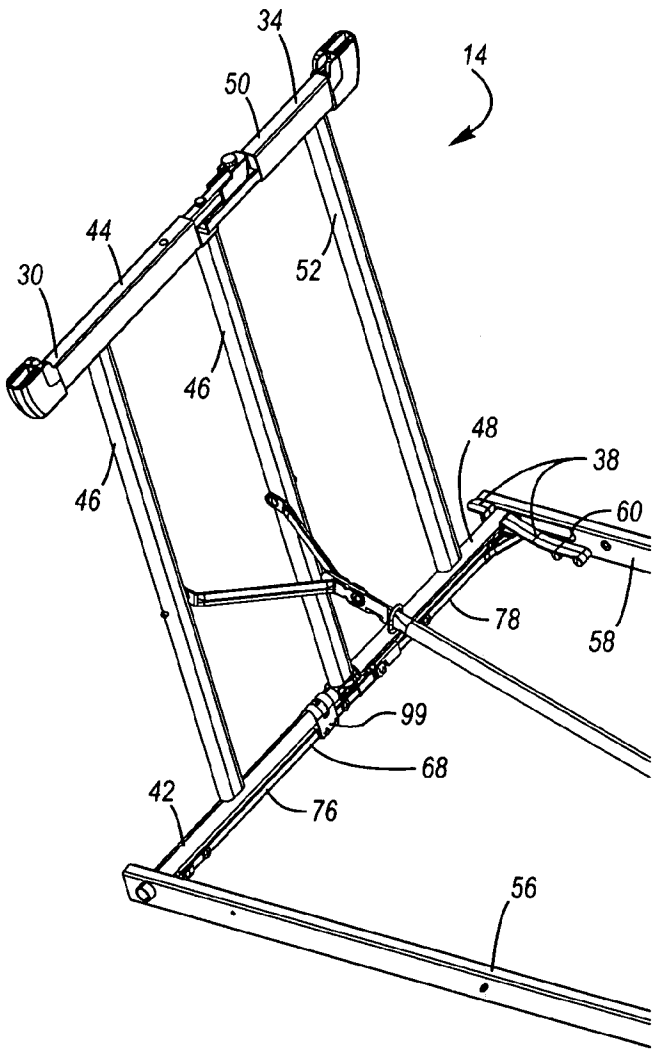
FIG. 11 is a lower perspective view of a portion of the table shown in FIG. 8.

As best seen in FIGS. 10-12, when the leg assemblies 14, 16 are in the extended or use position, the leg assemblies may be movable between a first position and a second position. As discussed in greater detail below, when the leg assemblies 14, 16 are in the first position, the table top sections 18, 20 are preferably supported in the generally aligned, first position. When the leg assemblies 14, 16 are in the second position, the table top sections 18, 20 are may be moved back and forth between the generally aligned, first position and the angled, second position.

Figure 14:
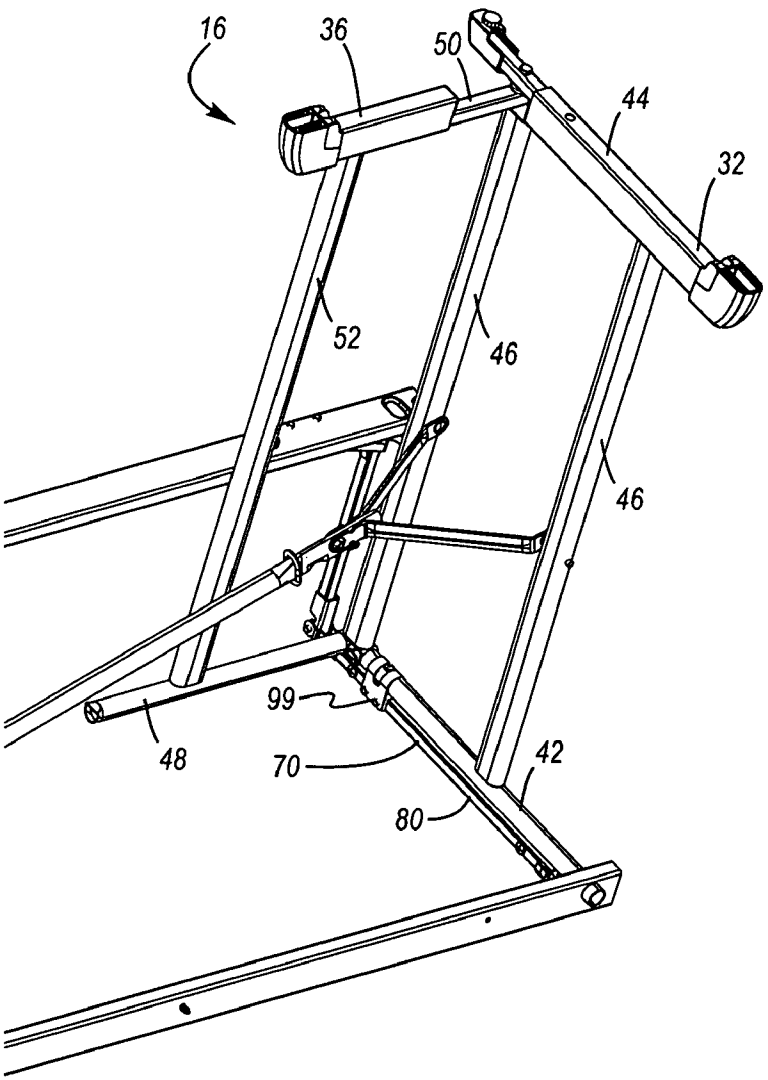
FIG. 14 is a lower perspective view of another portion of the table shown in FIG. 10.
Figure 13:
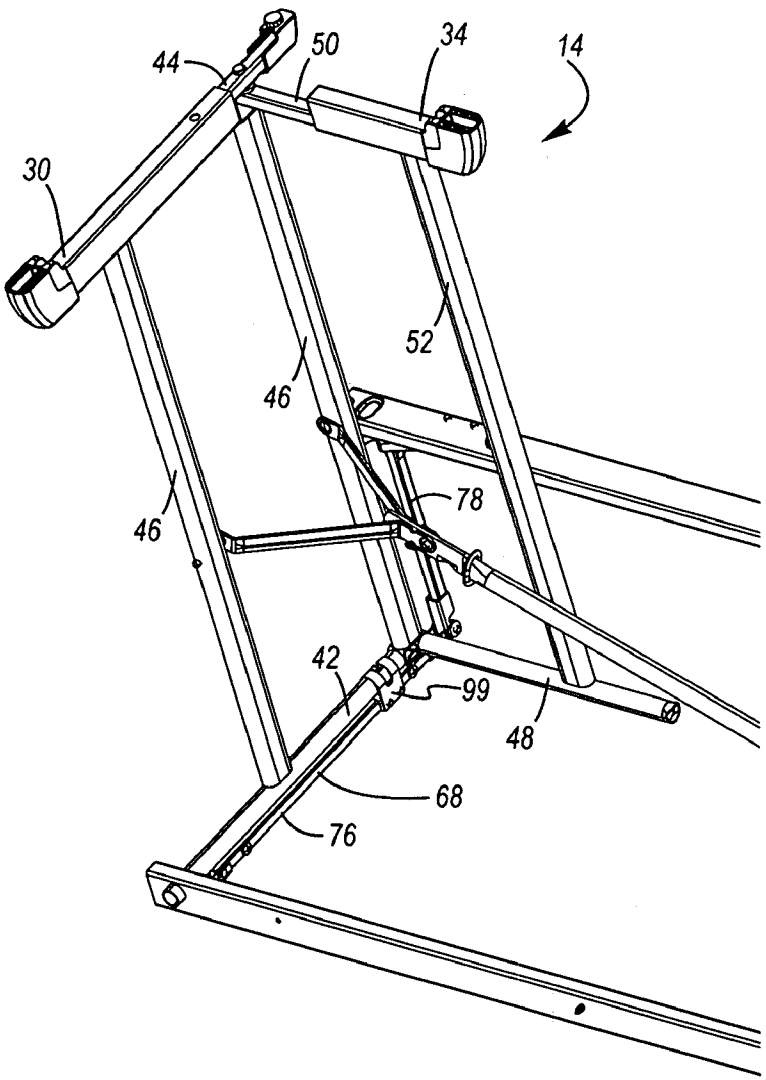
FIG. 13 is a lower perspective view of a portion of the table shown in FIG. 10.

In greater detail, each leg assembly 14, 16 may include a first support structure 30, 32 and a second support structure 34, 36. The support structures 30, 32, 34, 36 may be movable among various positions. For example, while the leg assemblies 14, 16 are in the extended or use position relative to the table top 12, the first and second support structures 30, 32, 34, 36 may be movable relative to each other. In particular, the second support structures 34, 36 may be moved between a first position in which the second support structures are generally aligned with the first support structures 30, 32 (such as shown in FIGS. 11 and 12) and a second position in which the second support structures are disposed at an angle relative to the first support structures (such as shown in FIGS. 13 and 14). As discussed below, when the second support structures 34, 36 are in the first position, the second support structures may help maintain the table top sections 18, 20 in the generally aligned position. When the second support structures 34, 36 are in the second position, the second support structures may allow the second table top section 20 to move into the angled position.

Advantageously, the first and second support structures 30, 32, 34, 36 may be pivotally connected to permit the second support structures to move between the first and second positions. This may allow the second support structures 34, 36 to swing like a gate between the first and second positions, if desired.

In further detail, as shown in FIGS. 11-14, the support structures 30, 32 may include an upper support 42, a lower support 44 and one or more legs 46 connected to the upper and/or lower supports. The support structures 34, 36 may also include an upper support 48, a lower support 50 and one or more legs 52 connected to the upper and/or lower supports. The upper supports 42, 48 may be movably interconnected, which may facilitate movement of the support structures 34, 36 relative to the support structures 30, 32. In addition, the lower supports 44, 50 may be movably interconnected, which may facilitate movement of the support structures 34, 36 relative to the support structures 30, 32. Preferably, the upper supports 42, 48 and the lower supports 44, 50 are pivotally connected, which may allow the support structures 34, 36 to swing like a gate between the first and second extended positions. It will be appreciated that the support structures 30, 32, 34, 36 may be connected in other suitable configurations and arrangements. In addition, it will be appreciated that the leg assemblies 14, 16 may have other suitable shapes, sizes, configurations and arrangements depending, for example, upon the intended use of the table 10. Further, it will be appreciated that the leg assemblies 14, 16 may include a variety of other structures having other suitable components and/or configurations.

When the support structures 34, 36 of the leg assemblies 14, 16 are in the first position, the support structures preferably support both the first and second table top sections 18, 20. In particular, the support structures 34, 36 may contact, abut and/or engage the table top section 20, the latches 38, 40 and/or other components of the table 10, which may help secure the table top sections 18, 20 in the generally aligned position. In further detail, as shown in FIG. 8, the table 10 may include a frame 54 that may contact, abut and/or engage the support structures 34, 36 to help secure the table top sections 18, 20. In particular, the frame 54 may include one or more elongated members, such as rails 56, 58, that may be respectively connected to the table top sections 18, 20, and the rails may include receiving portions that may be sized and configured to receive and/or retain a portion of the support structures 34, 36. For example, as shown in FIGS. 11 and 12, the rail 58 may include receiving portions 60, 62 (such as slots or other types of openings). The receiving portions 60, 62 may be sized and configured to receive and/or retain a portion of the upper supports 48 of the support structures 34, 36, when the support structures are moved from their angled positions shown in FIGS. 13-14 to their generally aligned positions shown in FIG. 11-12. It will be understood that the latches 38, 40 and receiving portions 60, 62, however, could be separate components that are connected to the frame 54 or other suitable portions of the table 10.

The latches 38, 40 may help retain the upper supports 48 in the desired positions, which may help secure the upper supports and the table top sections 18, 20 in the generally aligned position. The latches 38, 40 may be biased (for instance, spring-loaded) to automatically engage the upper supports 48 when the support structures 34, 36 are in the first position. The latches 38, 40 may also include a tab that may be pushed to disengage the latches from the upper supports 48, thus permitting the support structures 34, 36 to be moved from the first position to the second position.

As shown in FIG. 8, one or more guides 64 (such as ramps or other types of guides) may be sized and configured help align the upper supports 48 with the receiving portions 60, 62, which may help the receiving portions 60, 62 receive a portion of the upper supports. In particular, the guides 64 may help align the upper supports 48 with the receiving portions 60, 62 when the support structures 34, 36 are moved to the generally aligned position.

If desired, the guides 64 may be integrally formed in the table top section 20 as part of a unitary, one-piece structure. For example, the table top section 20 may be constructed from blow-molded plastic and the guides 64 may be integrally formed in the table top section 20 as part of a unitary, one-piece structure during the blow-molding process. In addition, the guides 64 may include a hollow interior portion that is formed during the blow-molding process and it may be in direct communication with a hollow interior portion of the table top 12 that is formed during the blow-molding process. The table top section 20 and the guides 64, however, do not have to be constructed from plastic or formed during a blow-molding process. The guides 64 and the table top 12 may be constructed from other suitable materials and processes, and the guides may be separate components that may be connected to the table top using fasteners, adhesives, and the like.

As discussed above, the table top sections 18, 20 may be movably connected, which may permit the table top section 20 to move between the first, generally aligned position and the second, angled position. In further detail, the table 10 may include hinges 66, 68, 70 as best seen in FIGS. 9, 11 and 12, respectively. The hinges 66, 68, 70 may include a first portion connected to the first table top section 18 and a second portion connected to the second table top section 20. In particular, as shown in FIG. 9, the hinge 66 may include supports 72, 74, which may be respectively connected to the table top sections 18, 20. In addition, as shown in FIG. 11, the hinge 68 may include supports 76, 78, which may be respectively connected to the table top sections 18, 20. Moreover, as shown in FIG. 12, the hinge 70 may include supports 80, 82, which may be respectively connected to the table top sections 18, 20.

Figure 16:
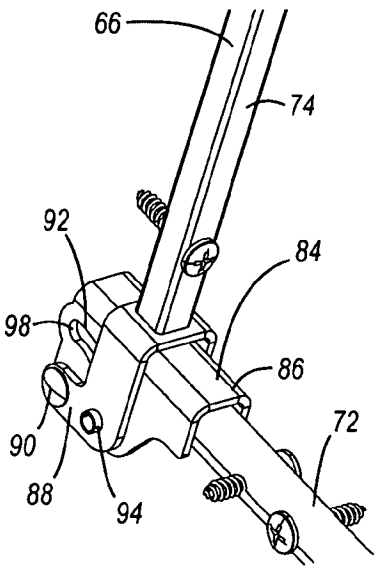
FIG. 16 is a lower perspective view of a portion of the table shown in FIG. 10, illustrating an exemplary hinge in a second position.
Figure 15:
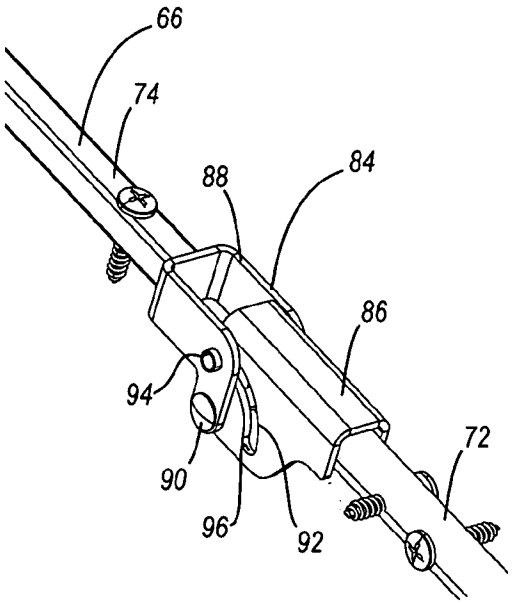
FIG. 15 is a lower perspective view of a portion of the table shown in FIG. 9, illustrating an exemplary hinge in a first position.

The hinges 66, 68, 70 may include brackets to connect the supports 72, 74, 76, 78, 80, 82, respectively. The brackets may be used to limit the relative movement of the table top sections 18, 20, if desired. For example, as shown in FIGS. 15 and 16, a bracket 84 may pivotally connect the supports 72, 74 of the hinge 66. The bracket 84 may include first and second portions 86, 88 that are connected using a pin 90. The bracket 84 may also include engaging portions that may engage each other to limit the relative movement of the bracket. In particular, the first portion of the bracket 86 may include elongated slots 92 and the second portion of the bracket 88 may be connected to one or more stops 94. The stops 94 may move within the slots 92 and when the stops 94 reach the ends 96, 98 of the slots 92, the stops may engage the ends to limit the relative movement of the table top sections 18, 20.

Thus, the hinge 66 may be sized and configured to limit the relative movement of the table top sections 18, 20 to a desired range of movement. In particular, the hinge 66 may be sized and configured to limit the relative movement of the table top sections 18, 20 to a desired range of movement between the first position in which the table top sections are generally aligned, as shown in FIG. 8, and the second position in which the table top sections are positioned at an angle, as shown in FIG. 10. The range of movement could be limited to about 90 degrees, but the range of movement could be larger or smaller, if desired. It will be appreciated that the table top sections 18, 20 could have any desired range of movement and hinges are not required to connect the table top sections. For example, other suitable connectors and structures may be used to connect the table top sections 18, 20.

If desired, some or all of the hinges 66, 68, 70 and/or the supports 72, 74, 76, 78, 80, 82 may be connected to the frame 54. For example, the supports 72, 76, 80 may be connected to the rail 56 and the supports 74, 78, 82 may be connected to the rail 58. The hinges 66, 68, 70 and the supports 72, 74, 76, 78, 80, 82, however, need not be connected to the frame 54 and could be connected to other suitable portions of the table 10.

As noted above, the leg assemblies 14, 16 may be sized and configured to move between an extended or use position (such as shown in FIG. 8) in which the leg assemblies extend away from a lower surface of the table top 12, and a collapsed or storage position (such as shown in FIG. 9) in which the leg assemblies may contact and/or abut the lower surface of the table top 12. The leg assemblies 14, 16 are preferably movable between the use and collapsed positions only when the support structures 30, 32, 34, 36 are in the first position. That is, when the support structures 30, 32, 34, 36 are in the first position, then the leg assemblies 14, 16 can be moved between the use and collapsed positions. In addition, when the leg assemblies 14, 16 are in the extended position, then the support structures 30, 32, 34, 36 may be moved between the first and second position. The support structures 30, 32, 34, 36, however, are preferably only movable between the first and second positions when the leg assemblies 14, 16 are in the extended or use positions.

In further detail, when the table top sections 18, 20 are generally aligned, the support structures 34, 36 may be positioned in the first position in which (as shown in FIGS. 11 and 12) the upper supports 42 of the support structures 30, 32 are generally aligned with the upper supports 48 of the support structures 34, 36. Desirably, when the upper supports 42, 48 are generally aligned, the upper supports may rotate relative to the frame 54, which may allow the leg assemblies 14, 16 and/or the support structures 30, 32, 34, 36 to move between the first position and the second position. In greater detail, a portion of the upper supports 42 may be disposed within one or more openings in the rail 56 to help the upper supports 42 rotatably couple the rail 56. In addition, when the upper supports 42, 48 are generally aligned, the latches 38, 40 may retain a portion of the supports 48 in the slots 60, 62 to help the supports 48 rotatably couple the rail 58. Accordingly, with the upper supports 42, 48 aligned and rotatably coupling openings in the frame 54, the legs assemblies 14, 16 and/or the support structures 30, 32, 34, 36 may be moved between the first extended position and the collapsed position.

If desired, when the table top sections 18, 20 are disposed at an angle as shown in FIG. 10, the legs assemblies 14, 16 and/or the support structures 30, 32, 34, 36 may be secured in a generally fixed position. For example, when the table top sections 18, 20 are disposed at an angle, the support structures 34, 36 may be positioned in the second position in which (as shown in FIGS. 13 and 14) the upper supports 48 of the support structures 34, 36 may be disposed at an angle to the upper supports 42 of the support structures 30, 32. Desirably, when the upper supports 42, 48 are disposed at an angle, the upper supports 42, 48 may be positioned to contact, abut and/or engage the table top section 18 in response to an attempt to move the leg assemblies 14, 16 and/or the support structures 30, 32, 34, 36 from the extended position to the collapsed position. This may help prevent the leg assemblies 14, 16 and/or the support structures 30, 32, 34, 36 from moving to the collapsed position and thus may secure the leg assemblies and/or the support structures in the extended position.

Moreover, when the table top sections 18, 20 are disposed at an angle, the table top section 20 and/or the rail 58 may be positioned to contact, abut and/or engage the support structures 34, 36 in response to an attempt to move the support structures from the second position to the first position. This may help further secure the legs assemblies 14, 16 and the support structures 30, 32, 34, 36 in a generally fixed extended position.

Thus, when moving the leg assemblies 14, 16 from the extended to the collapsed position, the table top sections 18, 20 may be moved into the first, generally aligned position and the support structures 34, 36 may be moved from the second position to the first position. The leg assemblies 14, 16 may then be moved from the extended position and to the collapsed position. When use of the table 10 is desired, the leg assemblies 14, 16 may be moved from the collapsed position to the extended position. If use of both the first and second sections 18, 20 of the table top 12 is desired, then no further action is required. However, if use of only the first section 18 of the table top 12 is desired or if the second table top section 20 is desired to be used as a modesty or privacy panel, then the support structures 34, 36 may be moved from the first position to the second position and the table top section 20 may be moved to a generally vertical or upright position.

As shown in FIGS. 11-14, the upper supports 42 of the support structures 30, 32 may be movably connected to the supports 76, 80 of the hinges 68, 70. For example, the supports 42 may be movably connected to the supports 76, 80 using a connecting assembly 99. The connecting assembly 99 may include a bracket and a pin. The bracket may be connected to a support 76, 80, and the pin may be connected to an upper support 42 and may extend through a slot or other type of opening formed in the bracket. Significantly, by extending through the slot formed in the bracket, the pin may help keep a portion of the upper support 42 disposed within one or more openings in the rail 56, when the upper supports 42, 48 are at an angle as shown in FIGS. 13 and 14. The pin may also be sized and configured to move along the slot of the bracket, which may allow the upper support 42 to rotate within the openings when the upper supports 42, 48 are generally aligned as shown in FIGS. 11 and 12.

As shown in FIG. 8, the table 10 may include one or more braces 100 that may be sized and configured to strengthen and/or reinforce the leg assemblies 14, 16. The braces 100 may move between extended and collapsed positions as the leg assemblies 14, 16 are moved between extended and collapsed positions. To facilitate this movement, the braces 100 may be connected to the table top section 18 and the support structures 30, 32. For example, a first end of the braces 100 may be connected to the legs 46 of the support structures 30, 32. In addition, to connect the braces 100 to the table top section 18, a second of the braces 100 may be connected to one or more supports connected to the table top section, for example, the support 72.

Figure 18:
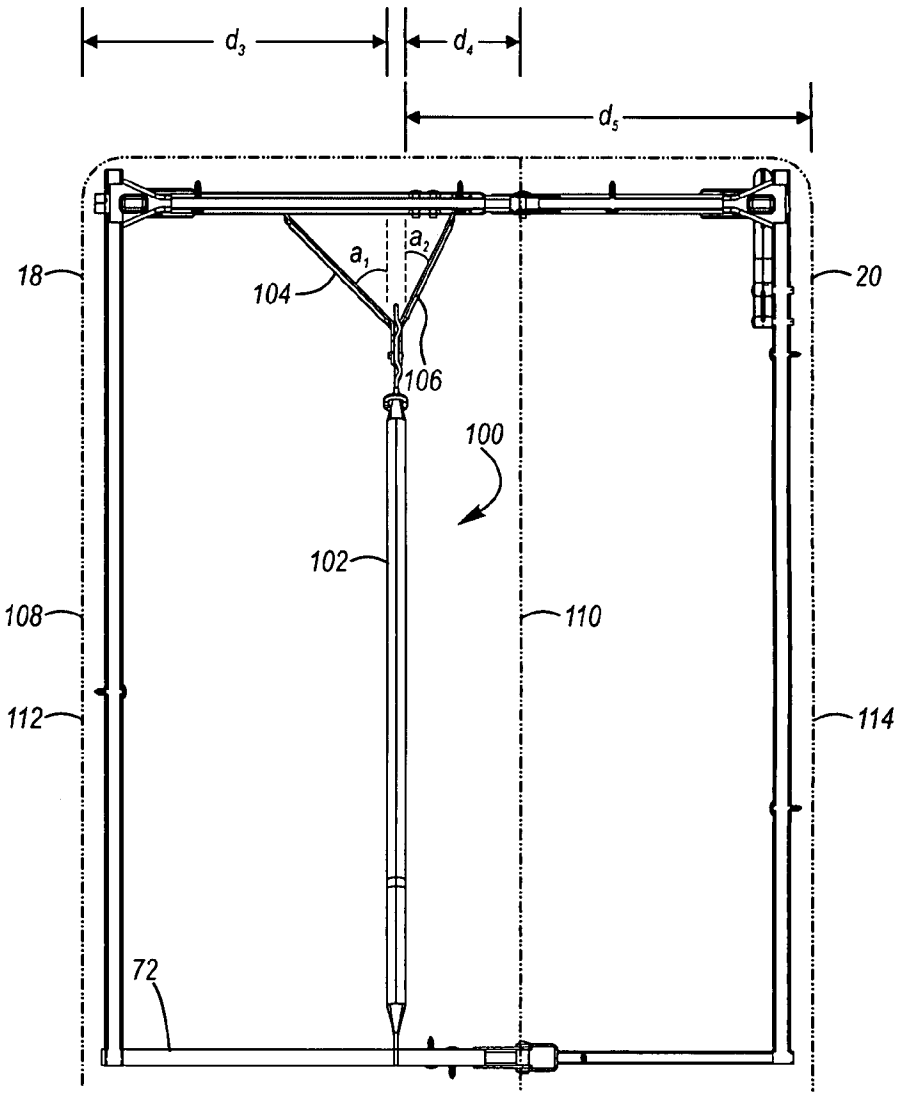
FIG. 18 is a lower view of a portion of the table shown in FIG. 1, illustrating the brace connected to the leg assembly.
Figure 17:
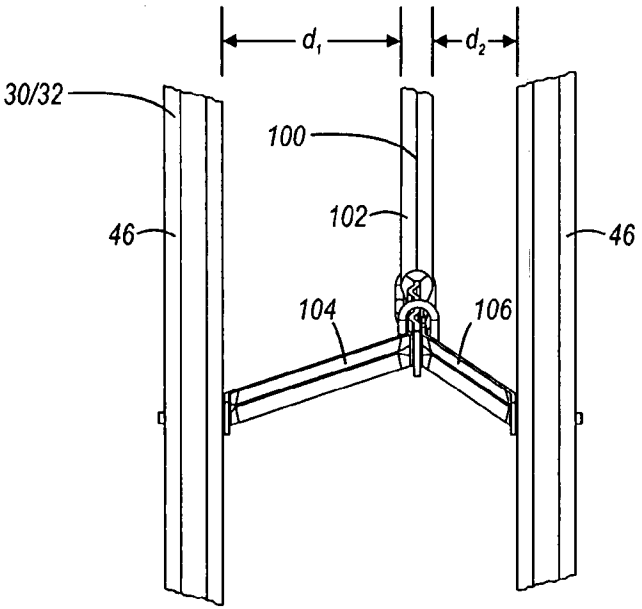
FIG. 17 is an enlarged side view of a portion of the table shown in FIG. 1, illustrating a portion of an exemplary brace and a portion of an exemplary leg assembly.

In further detail, as shown in FIGS. 17 and 18, a brace 100 may have a generally Y-shaped configuration, which may include an elongated member 102 and angled members 104, 106. The angled members 104, 106 may be connected to the legs 46 of the support structures 30, 32, and the elongated member 102 may be connected to the support 72 and the angled members.

The elongated member 102 may be positioned in a variety of offset positions. For example, as shown in FIG. 17, the elongated member 102 may be positioned in an offset position in which the elongated member is positioned at a first distance $d_1$ from a first leg 46 of the support structure 30, 32 and a second distance $d_2$ from a second leg 46 of the support structure. The distance $d_1$ from the first leg 46 may be at least about 1.5 times the distance $d_2$ from the second leg 46. For example, the distance $d_1$ may be between about 1.5 times to 2.5 times the distance $d_2$. The distance $d_1$ is preferably about twice the distance $d_2$.

As shown in FIG. 18, the elongated member 102 may be positioned in an offset position in which the elongated member is positioned at a distance $d_3$ from a first, outer edge or surface 108 of the table top section 18 and a distance $d_4$ from a second, inner edge or surface 108 of the table top section 18 that abuts, contacts and/or engages an inner edge or surface of the table top section 20. The distance $d_3$ may from the outer edge 108 be at least about 1.5 times the distance $d_4$ from the inner edge 110. For example, the distance $d_3$ may be between about two times to three times the distance $d_4$. The distance $d_3$ is preferably about 2.5 times the distance $d_4$.

In addition, the elongated member 102 may be positioned in an offset position in which the angled members 104, 106 may extend away from the elongated member at angles $a_1$, $a_2$, respectively. The angle $a_1$ may be at least about 1.5 times the angle $a_2$. For example, the angle $a_1$ may be between about 1.5 times to 2.5 times the angle $a_2$. The angle $a_1$ is preferably about twice the angle $a_2$.

The elongated member 102 may also be positioned in an offset position in which the elongated member is positioned at a distance $d_3$ from a first outer edge 112 of the table top 12 and a distance $d_5$ from a second outer edge 114 of the table top. The distance $d_5$ may from the outer edge 108 be at least about one to two times the distance $d_3$ from the inner edge 110. The distance $d_5$ is preferably about 1.3 times the distance $d_3$.

Significantly, when the elongated member 102 is positioned in an offset position, the table 10 may provide additional legroom, whether the table top sections 18, 20 are generally aligned or at an angle. It will be appreciated, however, that the distances $d_1$, $d_2$, $d_3$, $d_4$, $d_5$ may be larger or smaller and may have any other suitable relative sizes. It will also be appreciated that the angles $a_1$, $a_2$ may be larger or smaller and may have any other suitable relative sizes. It will be further appreciated that the elongated member 102 need not be positioned in an offset position and, if desired, the angles $a_1$, $a_2$ could be the same, the distances $d_1$, $d_2$ could be the same, the distances $d_3$, $d_4$ could be the same and/or the distances $d_3$, $d_5$ could be the same.

Figure 19:
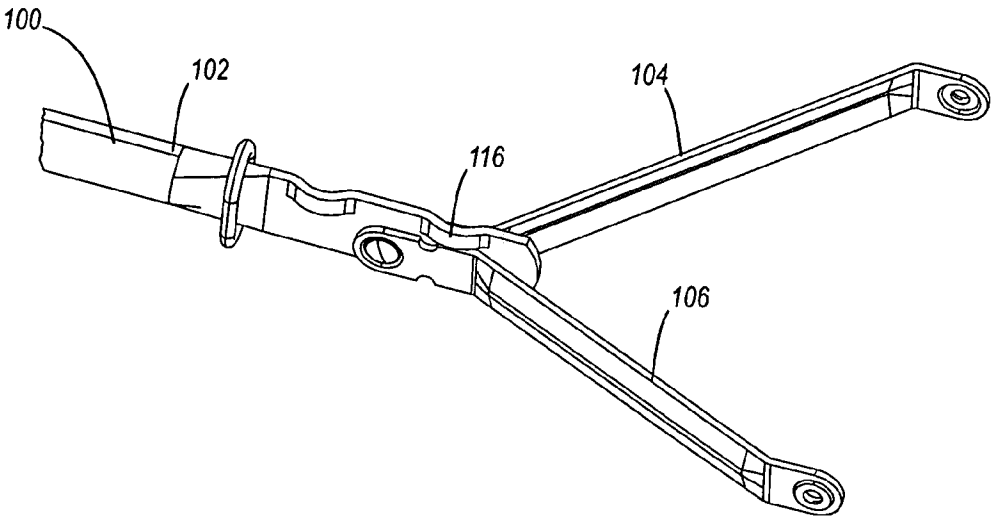
FIG. 19 is an enlarged perspective view of a portion of the brace.
Figure 20:
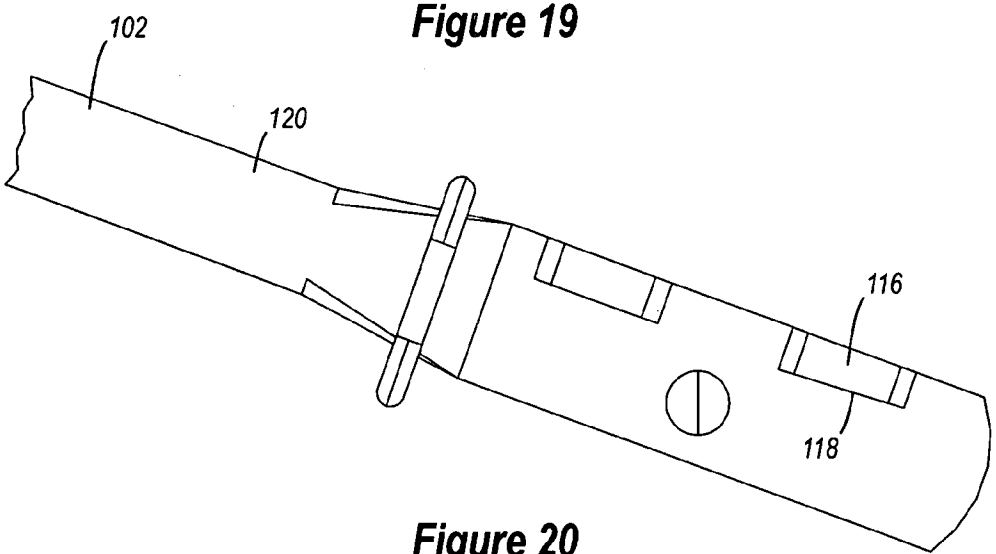
FIG. 20 is an enlarged side view of a portion of the brace.

As shown in FIGS. 19 and 20, the elongated member 102 may include a stop 116 that may be sized and configured to contact, abut and/or engage one or more of the angled members 104, 106 to limit the movement of the brace 100. In further detail, the stop 116 may include an edge 118 that may be configured to contact, abut and/or engage the angled member 106. This may advantageously help prevent the angled members 104, 106 from rotating beyond a desired position relative to the elongated member 102.

As shown in FIG. 20, the edge 118 may be disposed at an angle relative to a body 120 the elongated member 102. In particular, the edge 118 may be disposed at an angle that is at least about two, three, four, five, six, seven, eight, nine, ten or more degrees relative to the body 120. For example, the edge 118 may be disposed at an angle that is between about two to five degrees relative to the body 120. The edge 118 is preferably disposed at an angle that is about three degrees relative to the body 120. It will be appreciated, however, that the edge 118 could be disposed at other suitable angles. It will also be appreciated that the edge 118 need not be disposed at any angle relative to the body 120 and could be exactly aligned with the body, if desired.

Figure 21:
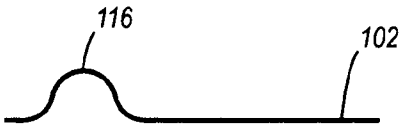
FIG. 21 is a side view of an exemplary latch that may be used to secure a portion of a leg assembly in a fixed position.
Figure 22:
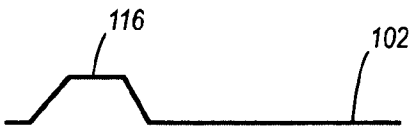
FIG. 22 is a side view of another exemplary latch that may be used to secure a portion of a leg assembly in a fixed position.
Figure 23:
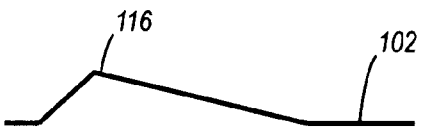
FIG. 23 is a side view of still another exemplary latch that may be used to secure a portion of a leg assembly in a fixed position.

The stop 116 may have a variety of shapes. For example, the stop 116 may have a curved shape, a multi-angled shape or a single-angled shape, as shown in FIGS. 21, 21, and 23, respectively. The elongated member 102 and the stop 116 may, if desired, be constructed from metal and the curved, multi-angled or a single-angled shape may be formed during a bending process. It will be appreciated, however, that the elongated member 102 and the stop 116 may be constructed from other suitable materials using other suitable processes and that the stop may have any other suitable size, shape and/or configuration.

Referring now back to FIG. 2, the support structures 30, 32 may be sized and configured to increase the stability of the table 10 when the table top sections 18, 20 are disposed at an angle. In further detail, the support structures 30, 32 may include feet 122, 124 that may be connected to or form part of the lower supports 44 of the support structures. Desirably, the feet 122, 124 may have a wider stance that may help increase the stability of the table 10 when the table top sections 18, 20 are disposed at an angle. To facilitate this wider stance, the support structures 34, 36 may have receiving portions 126 that may be sized and configured to receive at least a substantial portion of the feet 124 and/or the lower supports 44 when, as shown in FIG. 1, the table top sections 18, 20 and the support structures are generally aligned. In addition, to facilitate this wider stance, at least a substantial portion of the feet 124 may be disposed under the lower supports 50 of the support structures 34, 36 when the table top sections 18, 20 and the support structures are generally aligned.

If desired, the table top 12 may be constructed from plastic, preferably using a blow-molding process. Advantageously, this may allow a lightweight table top to be easily constructed and it may allow the table top to be formed into various desired configurations, shapes, sizes and designs. This may also allow a table top to be constructed that is generally weather resistant and temperature insensitive, which may allow the table to be used in a wide variety of locations and environments. In addition, this may create a table top that is durable, long-lasting and corrosion resistant. Further, because the blow-molded plastic table top may be relatively strong, the table may be used to support a relatively large amount of weight. For example, a table top constructed from blow-molded plastic may be relatively strong because it may include opposing walls or surfaces that are separated by a distance. The opposing walls may help create a high-strength, rigid table top. In addition, because the interior portion of the table top may be hollow, that may create a lightweight table top. Thus, the blow-molded plastic table top may be both lightweight and strong.

Moreover, if the table top 12 is constructed from blow-molded plastic, one or more features of the table top may be integrally formed in the table top as part of unitary, one piece structure during the molding process. For example, if the table top sections 18, 20 are constructed from blow-molded plastic, then the projections 22, recesses 24, reinforcing members 26, guides 64 and hollow interior portions may be integrally formed as part of unitary, one piece structure during the blow-molding process. It will be appreciated, however, that the table top 12 and/or table top sections 18, 20 need not be constructed using plastic or a blow-molding process. It will be understood that the table top 12 and table top sections 18, 20 may be constructed from other materials, such as metal, wood and the like, and other process to create a table 12 with the desired properties and characteristics.

The leg assemblies 14, 16; frame 54; hinges 66, 68, 70; and braces 100 are preferably constructed from metal, such as metal tubes, stamped metal components and the like. Desirably, these components are constructed from metal for high strength. It will be appreciated that these components may be constructed from other suitable materials and processes. It will also be appreciated that these components may have a variety of suitable shapes, sizes, configurations and arrangements depending, for example, upon the intended use of the table 1*o*. In addition, it will be appreciated that the table 10 does not require any of these components and the table could include other components depending, for example, upon the particular configuration of the table.

Other suitable features for tables are disclosed in U.S. provisional patent application Ser. No. 60/951,148, filed on Jul. 20, 2007, the disclosure of which is incorporated by reference in its entirety.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top comprising:

a first table top section; and a second table top section movably connected to the first table top section, the first and second table top sections movable between a first position in which the table top sections are generally in the same plane and a second position in which the table top sections are disposed at an angle;

a first leg assembly movably connected to the table top, the first leg assembly comprising:

a first support structure; and a second support structure, the first and second support structures movable between a first position in which the support structures are generally in the same plane and a second position in which the support structures are disposed at an angle;

wherein the first leg assembly is movable between a use position in which the first support structure of the first leg assembly extends outwardly from a lower surface of the first table top section and the second support structure of the first leg assembly extends outwardly from a lower surface of the second table top section, and a collapsed position in which the first support structure of the first leg assembly is disposed at least substantially adjacent the lower surface of the first table top section and the second support structure of the first leg assembly is disposed at least substantially adjacent the lower surface of the second table top section when the first and second table top sections are in the first position and the first and second support structures are in the first position; and a second leg assembly movably connected to the table top, the second leg assembly comprising:

a first support structure; and a second support structure, the first and second support structures movable between a first position in which the support structures are generally in the same plane and a second position in which the support structures are disposed at an angle;

wherein the second leg assembly is movable between a use position in which the first support structure of the second leg assembly extends outwardly from the lower surface of the first table top section and the second support structure of the second leg assembly extends outwardly from the lower surface of the second table top section, and a collapsed position in which the first support structure of the second leg assembly is disposed at least substantially adjacent the lower surface of the first table top section and the second support structure of the second leg assembly is disposed at least substantially adjacent the lower surface of the second table top section;

wherein the second support structure of the first leg assembly is movable between the first and second positions when the first leg assembly is in the use position;

wherein the second support structure of the second leg assembly is movable between the first and second positions when the second leg assembly is in the use position;

wherein a portion of the second support structure of the first leg assembly and a portion of the second support structure of the second leg assembly are positioned to retain the second table top section in the first position when the second support structure of the first leg assembly and the second support structure of the second leg assembly are in the first position; and wherein the second support structure of the first leg assembly and the second support structure of the second leg assembly are positioned to allow the second table top section to be moved between the first position and the second position when the second support structure of the first leg assembly is in the second position.

2. The table as in claim 1, wherein the first leg assembly is sized and configured to be retained in the second position when the second support structure of the first leg assembly is in the second position.

3. The table as in claim 2, wherein the second leg assembly is sized and configured to be retained in the second position when the second support structure of the second leg assembly is in the second position.

4. The table as in claim 1, wherein the second table top section is sized and configured to retain the second support structures of the first and second leg assemblies in the second position.

5. The table as in claim 1, further comprising a rail connected to the second table top section, the rail including a receiving portion sized and configured to receive a first portion of the second support structure of the first leg assembly when the second support structure of the first leg assembly is in the first position, the first portion of the second support structure of the first leg assembly being disposed away from the receiving portion of the rail when the second support structure of the first leg assembly is in the second position.

6. The table as in claim 5, further comprising a latch sized and configured to retain the first portion of the second support structure of the first leg assembly within the receiving portion of the rail.

7. The table as in claim 5, wherein the second table top section includes a ramp sized and configured to guide the first portion of the second support structure of the first leg assembly into the receiving portion of the rail as the second support structure of the first leg assembly is moved from the second position to the first position.

8. The table as in claim 1, further comprising a rail connected to the second table top section;

wherein the first support structure of the first leg assembly comprises an upper support, a lower support and a leg connected to the upper and lower supports of the first support structure of the first leg assembly;

wherein the second support structure of the first leg assembly comprises an upper support, a lower support and a leg connected to the upper and lower supports of the second support structure of the first leg assembly;

wherein the upper support of the first support structure of the first leg assembly is movably connected to the upper support of the second support structure of the first leg assembly;

wherein the lower support of the first support structure of the first leg assembly is movably connected to the lower support of the second support structure of the first leg assembly; and wherein the rail includes a receiving portion sized and configured to receive a first portion of the upper support of the second support structure of the first leg assembly when the second support structure of the first leg assembly is in the first position, the first portion of the upper support of the first leg assembly being disposed away from the receiving portion of the rail when the second support structure of the first leg assembly is in the second position.

9. The table as in claim 8, further comprising a latch sized and configured to retain the first portion of the upper support of the second support structure of the first leg assembly within the receiving portion of the rail.

10. The table as in claim 8, wherein the second table top section includes a ramp sized and configured to guide the first portion of the upper support of the second support structure of the first leg assembly into the receiving portion of the rail as the second support structure of the first leg assembly is moved from the second position to the first position.

11. The table as in claim 1, further comprising a hinge movably interconnecting the first and second table top sections, a range of relative movement of the first and second table top sections being about ninety degrees.

12. The table as in claim 1, further comprising a brace movably connected to the first table top section and to the first support structure of the first leg assembly, the brace including:

an elongated member;

a first angled member movably connected to the elongated member; and a second angled member movably connected to the elongated member.

13. The table as in claim 12, wherein the elongated member of the brace is positioned in an offset position in which the elongated member is positioned at a first distance from a first outer edge of the first table top section and a second distance from a opposing second outer edge of the first table top section, the first distance being between about two to three times the distance of the second distance.

14. The table as in claim 12, wherein the elongated member comprises a body and a stop, the stop including an edge sized and configured to engage the first angled member to limit the rotation of the first angled member relative to the elongated member, the edge being disposed at an angle relative to the body of the elongated member, the angle being at least two degrees.

15. The table as in claim 1, wherein the first and second table top sections include a plurality of interlocking portions sized and configured to form a corner between the first and second table top sections when the first and second table top sections are at an angle of about ninety degrees.

16. A method of using a table that includes a table top including a first table top section and a second table top section, a first leg assembly including a first support structure and a second support structure and a second leg assembly including a first support structure and a second support structure, the method comprising:

moving the first leg assembly from a collapsed position in which the first support structure of the first leg assembly is disposed at least substantially adjacent a lower surface of the first table top section and the second support structure of the first leg assembly is disposed at least substantially adjacent a lower surface of the second table top section to a use position in which the first support structure of the first leg assembly extends outwardly from the lower surface of the first table top section and the second support structure of the first leg assembly extends outwardly from the lower surface of the second table top section;

moving the second leg assembly from a collapsed position in which the first support structure of the second leg assembly is disposed at least substantially adjacent the lower surface of the first table top section and the second support structure of the second leg assembly is disposed at least substantially adjacent the lower surface of the second table top section to a use position in which the first support structure of the second leg assembly extends outwardly from the lower surface of the first table top section and the second support structure of the second leg assembly extends outwardly from the lower surface of the second table top section;

moving the second support structures of the first and second leg assemblies, when the first and second leg assembles are in the use position, from a first position in which a portion of the second support structure of the first leg assembly and a portion of the second support structure of the second leg assembly are positioned to retain the second table top section in a generally aligned position relative to the first table top section to a second position that allows the second table top section to be moved between the generally aligned position and an angled position relative to the first table top section; and moving the second table top section from the generally aligned position to the angled position relative to the first table top section.

17. The method as in claim 16, wherein the first leg assembly is sized and configured to be retained in the use position when the second support structure of the first leg assembly is in the second position; and wherein the second leg assembly is sized and configured to be retained in the use position when the second support structure of the second leg assembly is in the second position.

18. The method as in claim 16, wherein the second table top section is sized and configured to, when in the angled position relative to the first table top section, retain the second support structures of the first and second leg assemblies in the second position.

19. A table comprising:

a table top comprising:

a first table top section; and a second table top section between a first position in which the first and second table top sections are generally in the same plane and a second position in which the first and second table top sections are disposed at an angle; and a first leg assembly comprising:

a first support structure connected to the first table top section; and a second support structure movable between a first position in which the first and second support structures are generally in the same plane and a second position in which the first and second support structures are disposed at an angle;

wherein the first leg assembly is movable between a use position in which the first and second support structures of the first leg assembly extend outwardly to support the table top above a surface and a collapsed position in which the first and second support structures of the first leg assembly are disposed at least substantially adjacent the first and second table top sections;

wherein the second support structure of the first leg assembly is movable between the first and second positions when the first leg assembly is in the use position;

wherein the second support structure of the first leg assembly retains the second table top section in the first position when the second support structure is in the first position; and wherein the second support structure of the first leg assembly allows the second table top section to be moved between the first position and the second position when the second support structure of the first leg assembly is in the second position.

20. The table as in claim 19, further comprising a second leg assembly comprising:

a first support structure connected to the first table top section; and a second support structure movable between a first position in which the first and second support structures are generally in the same plane and a second position in which the first and second support structures are disposed at an angle;

wherein the second leg assembly is movable between a use position in which the first and second support structures of the second leg assembly extend outwardly to support the table top above a surface and a collapsed position in which the first and second support structures of the second leg assembly are disposed at least substantially adjacent the first and second table top sections;

wherein the second support structure of the second leg assembly is movable between the first and second positions when the second leg assembly is in the use position;

wherein the second support structure of the second leg assembly retains the second table top section in the first position when the second support structure is in the first position; and wherein the second support structure of the second leg assembly allows the second table top section to be moved between the first position and the second position when the second support structure of the first leg assembly is in the second position.

* * * * *

UNITED STATES PATENT AND TRADEMARK OFFICE

CERTIFICATE OF CORRECTION

PATENT NO. : 7,975,625 B2
APPLICATION NO. : 12/237111
DATED : July 12, 2011
INVENTOR(S) : Topham et al.

It is certified that error appears in the above-identified patent and that said Letters Patent is hereby corrected as shown below:

On Page 2, item (56), under "U.S. PATENT DOCUMENTS", in Column 1, Line 8, delete "Rica" and insert -- Ricca --, therefor.

In Column 6, Line 34, delete "18," and insert -- 18, 20 --, therefor.

In Column 14, Line 7, delete "table 12" and insert -- table 10 --, therefor.

In Column 14, Line 18, delete "table 1o." and insert -- table 10. --, therefor.

Signed and Sealed this
Seventh Day of August, 2012

David J. Kappos

David J. Kappos
*Director of the United States Patent and Trademark Office*